US008267258B2

(12) United States Patent
Allwright et al.

(10) Patent No.: US 8,267,258 B2
(45) Date of Patent: Sep. 18, 2012

(54) TRAY ASSEMBLY

(75) Inventors: Julia Allwright, London (GB); David Neil Petley, Hertfordshire (GB); Richard Thomas Calhoun Bridges, London (GB)

(73) Assignee: Xerox Corporation, Norwalk, CT (US)

( * ) Notice: Subject to any disclaimer, the term of this patent is extended or adjusted under 35 U.S.C. 154(b) by 398 days.

(21) Appl. No.: 12/429,639

(22) Filed: Apr. 24, 2009

(65) Prior Publication Data

US 2010/0270250 A1 Oct. 28, 2010

(51) Int. Cl.
*A47F 7/00* (2006.01)

(52) U.S. Cl. ..... 211/59.3

(58) Field of Classification Search ..... 211/59.3, 211/133.6, 184, 43; 248/354.7, 354.6
See application file for complete search history.

(56) References Cited

U.S. PATENT DOCUMENTS

| | | | | | |
|---|---|---|---|---|---|
| 561,451 | A | | 6/1896 | Succop | |
| 823,775 | A | | 6/1906 | Harryman | |
| 1,338,066 | A | * | 4/1920 | Blocker | 294/166 |
| 2,079,754 | A | * | 5/1937 | Waxgiser | 211/59.3 |
| 2,124,755 | A | * | 7/1938 | Simpson et al. | 297/344.12 |
| 2,411,900 | A | * | 12/1946 | Seward | 248/354.7 |
| 2,895,704 | A | * | 7/1959 | Urbain et al. | 248/354.7 |
| 3,487,945 | A | * | 1/1970 | Barham | 211/43 |
| 3,559,515 | A | | 2/1971 | Kyser | |
| 3,802,658 | A | * | 4/1974 | Binding | 248/352 |
| 4,343,450 | A | * | 8/1982 | Anderson | 248/454 |
| 4,458,874 | A | * | 7/1984 | Rabas et al. | 248/670 |
| 4,746,087 | A | * | 5/1988 | Beaton | 248/694 |
| 4,798,162 | A | * | 1/1989 | Nelson | 118/26 |
| 4,897,958 | A | * | 2/1990 | Brydges | 47/68 |
| 5,334,354 | A | | 8/1994 | Johnston et al. | |
| 5,413,229 | A | * | 5/1995 | Zuberbuhler et al. | 211/59.3 |
| 5,657,878 | A | * | 8/1997 | Austin | 211/41.8 |
| 6,227,513 | B1 | * | 5/2001 | Richard | 248/346.07 |
| 6,302,390 | B1 | | 10/2001 | Clark et al. | |
| 6,536,968 | B2 | | 3/2003 | Lee et al. | |
| 6,637,605 | B2 | * | 10/2003 | Ernst | 211/70.6 |
| 6,691,891 | B2 | * | 2/2004 | Maldonado | 221/279 |
| 6,823,997 | B2 | * | 11/2004 | Linden et al. | 211/59.3 |
| 6,842,951 | B1 | | 1/2005 | Barre et al. | |
| 7,198,158 | B2 | * | 4/2007 | Kao | 211/70.6 |
| 7,293,666 | B2 | * | 11/2007 | Mattlin et al. | 211/189 |
| 7,331,567 | B2 | * | 2/2008 | Li | 254/95 |
| 7,717,276 | B2 | * | 5/2010 | Alves | 211/59.2 |
| 7,905,364 | B2 | * | 3/2011 | Pail | 211/59.3 |
| 2003/0150829 | A1 | * | 8/2003 | Linden et al. | 211/126.1 |
| 2004/0036208 | A1 | | 2/2004 | Yanagi et al. | |
| 2004/0245197 | A1 | * | 12/2004 | McElvaney | 211/184 |
| 2006/0076301 | A1 | * | 4/2006 | Caterinacci et al. | 211/59.3 |
| 2006/0118499 | A1 | * | 6/2006 | Kao | 211/70.6 |
| 2006/0140695 | A1 | | 6/2006 | Yonemoto et al. | |

(Continued)

*Primary Examiner* — Jennifer E. Novosad
(74) *Attorney, Agent, or Firm* — Fox Rothschild LLP

(57) ABSTRACT

A tray assembly may include a tray having at least a first track and a second track. The first track and the second track may each include one or more indents and one or more ratchets. Each ratchet may include a plurality of projections, and each projection may be located a distance from each adjacent projection. A tray assembly may include a guide assembly having a first latch coupled to a second latch. The first latch may include a plurality of first teeth configured to engage the first track, and the second latch may include a plurality of second teeth configured to engage the second track. The tray assembly may include a compression element configured to lock and unlock the guide assembly.

12 Claims, 14 Drawing Sheets

U.S. PATENT DOCUMENTS

2006/0222434 A1 10/2006 Kitamura et al.
2006/0237381 A1* 10/2006 Lockwood et al. ..... 211/59.3
2007/0068885 A1* 3/2007 Busto et al. ..... 211/59.3
2008/0017598 A1* 1/2008 Rataiczak et al. ..... 211/59.3
2010/0096345 A1* 4/2010 Crawbuck et al. ..... 211/59.3
2010/0270250 A1 10/2010 Allwright et al.
2010/0270734 A1 10/2010 Bridges et al.
2010/0276383 A1* 11/2010 Hardy ..... 211/59.3

* cited by examiner

TRAY ASSEMBLY

CROSS REFERENCE TO RELATED APPLICATIONS

This application is related to U.S. patent application Ser. No. 12/429,679 filed Apr. 24, 2009.

Not Applicable

BACKGROUND

Sheet stacking tray assemblies are known in the art and described in, for example, U.S. Pat. No. 6,302,390 to Clark et al. Conventional sheet stacking tray assemblies have one or more adjustable guides. For example, a paper tray in a printer typically includes a guide that is adjustable to accommodate paper of different sizes.

However, guides can be shifted out of position when a sheet stacking tray assembly is loaded, unloaded and/or the like. For example, a guide can be shifted out of position when the dynamic forces of the stack act against the guide as a tray is pushed home with force.

When a guide is shifted out of position, the capabilities of the resource that houses the sheet stacking tray assembly are often comprised. For example, the resource could be unable to detect the correct size of the media that has been loaded. In addition, the media stack could become offset relative to the machine registration datum, which could affect print quality. In addition, an offset stack might cause a paper jam. Paper jams, in turn, can frustrate customers and can reduce the overall feeding quality and capabilities of the resource.

SUMMARY

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

It must be noted that as used herein and in the appended claims, the singular forms "a," "an," and "the" include plural reference unless the context clearly dictates otherwise. Unless defined otherwise, all technical and scientific terms used herein have the same meanings as commonly understood by one of ordinary skill in the art. As used herein, the term "comprising" means "including, but not limited to."

In an embodiment, a tray assembly may include a tray having at least a first track and a second track. The first track and the second track may each include one or more indents and one or more ratchets. Each ratchet may include a plurality of projections, and each projection may be located a distance from each adjacent projection. A tray assembly may include a guide assembly having a first latch coupled to a second latch. The first latch may include a plurality of first teeth configured to engage the first track, and the second latch may include a plurality of second teeth configured to engage the second track. The tray assembly may include a compression element configured to lock and unlock the guide assembly.

In an embodiment, a tray assembly may include a tray having at least a first track and a second track. The first track may include one or more indents and one or more first ratchets. The second track may include one or more second ratchets, and each of the first ratchets and each of the second ratchets may include a plurality of projections. The tray assembly may include a guide assembly having a first latch coupled to a second latch. The first latch may include a plurality of first teeth configured to engage the first track. The second latch may include a plurality of second teeth configured to engage the second track. The tray assembly may include a compression element configured to lock and unlock the guide assembly.

BRIEF DESCRIPTION OF THE DRAWINGS

Aspects, features, benefits and advantages of the present invention will be apparent with regard to the following description and accompanying drawings, of which.

DETAILED DESCRIPTION

For purposes of the discussion below, a "sheet" refers to a physical sheet of paper, plastic and/or other suitable media for printing images thereon.

A "resource" refers to a printer, a copier, a multifunction machine or system, a xerographic machine or system, or any other type of reproduction or printing apparatus that is capable of printing images on at least a portion of a sheet.

A "sheet stack" refers to a plurality of sheets arranged vertically.

In an embodiment, a sheet stacking tray assembly may be a component of a resource. In an embodiment, the sheet stacking tray assembly may be mounted in a slide-out paper drawer unit of a resource. For example, a slidable print tray may comprise a sheet stacking tray assembly in a printer.

Figure 1:
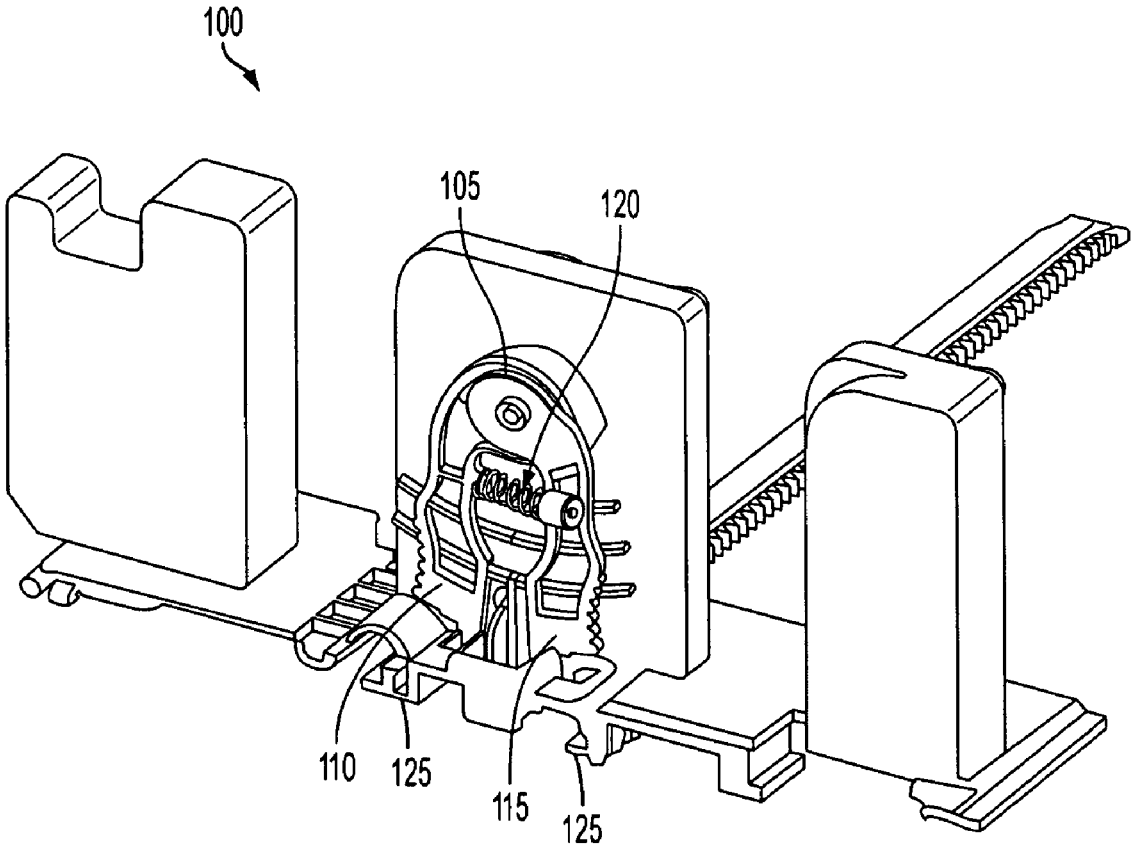
FIG. 1 illustrates an exemplary guide assembly according to an embodiment.

In an embodiment, a sheet stacking tray assembly may comprise a tray and one or more guide assemblies. FIG. 1 illustrates an exemplary guide assembly 100 according to an embodiment. A guide assembly 100 may include a locking mechanism, such as a double latch 105 and/or the like, as illustrated by FIG. 1. In an embodiment, each guide assembly may be independently repositioned along the length and/or width of the tray so as to accommodate different sheet sizes. In an embodiment, a guide assembly may not be mounted on the tray and may not move with the tray.

In an embodiment, a guide assembly 100 may include one or more connection elements 125 such as projections, recesses and/or the like. For example, as illustrated by FIG. 1, the guide assembly 100 may have one or more hooks or other similar projections. In an embodiment, the guide assembly 100 may have one or more indents or other similar recesses. In an embodiment, the guide assembly 100 may have a combination of projections and recesses. In an embodiment, one or more of the connection elements 125 may be integrally formed with the guide assembly.

In an embodiment, one or more of the connecting elements 125 of the guide assembly 100 may be complementary to one or more of the connecting elements of the tray. In an embodiment, one or more of the connecting elements 125 of the guide assembly 100 may connect to and/or interlock with one or more complementary connecting elements 125 located on the tray. In an embodiment, one or more of the connection elements may be integrally formed with the tray. For example, the guide assembly 100 may include one or more protrusions that interconnect with one or more recesses located on the tray. In an embodiment, connecting the guide assembly to the tray via one or more connecting elements may assist in restraining movement of the guide assembly relative to the tray.

Figure 2A:
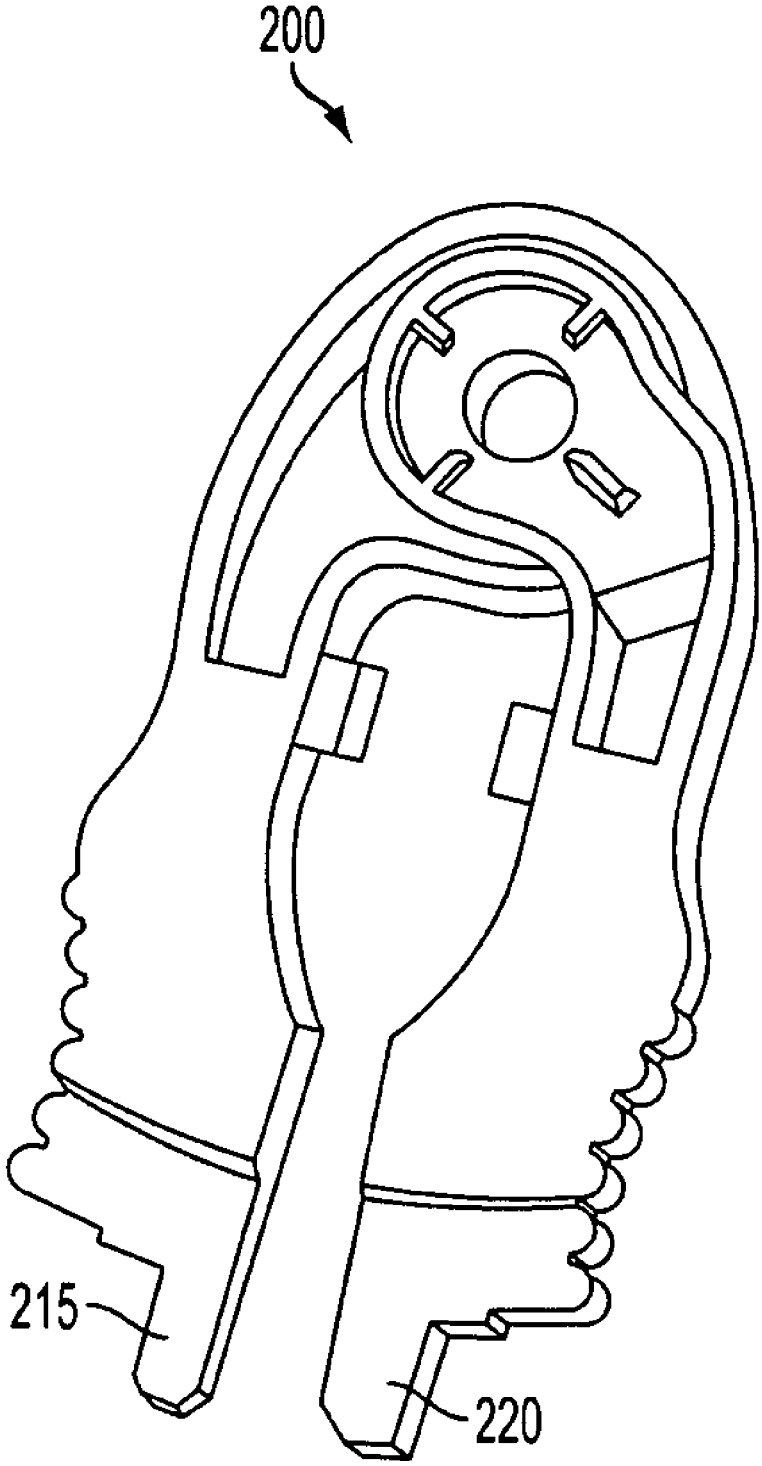
FIG. 2A illustrates an exemplary locking mechanism according to an embodiment.
Figure 2B:
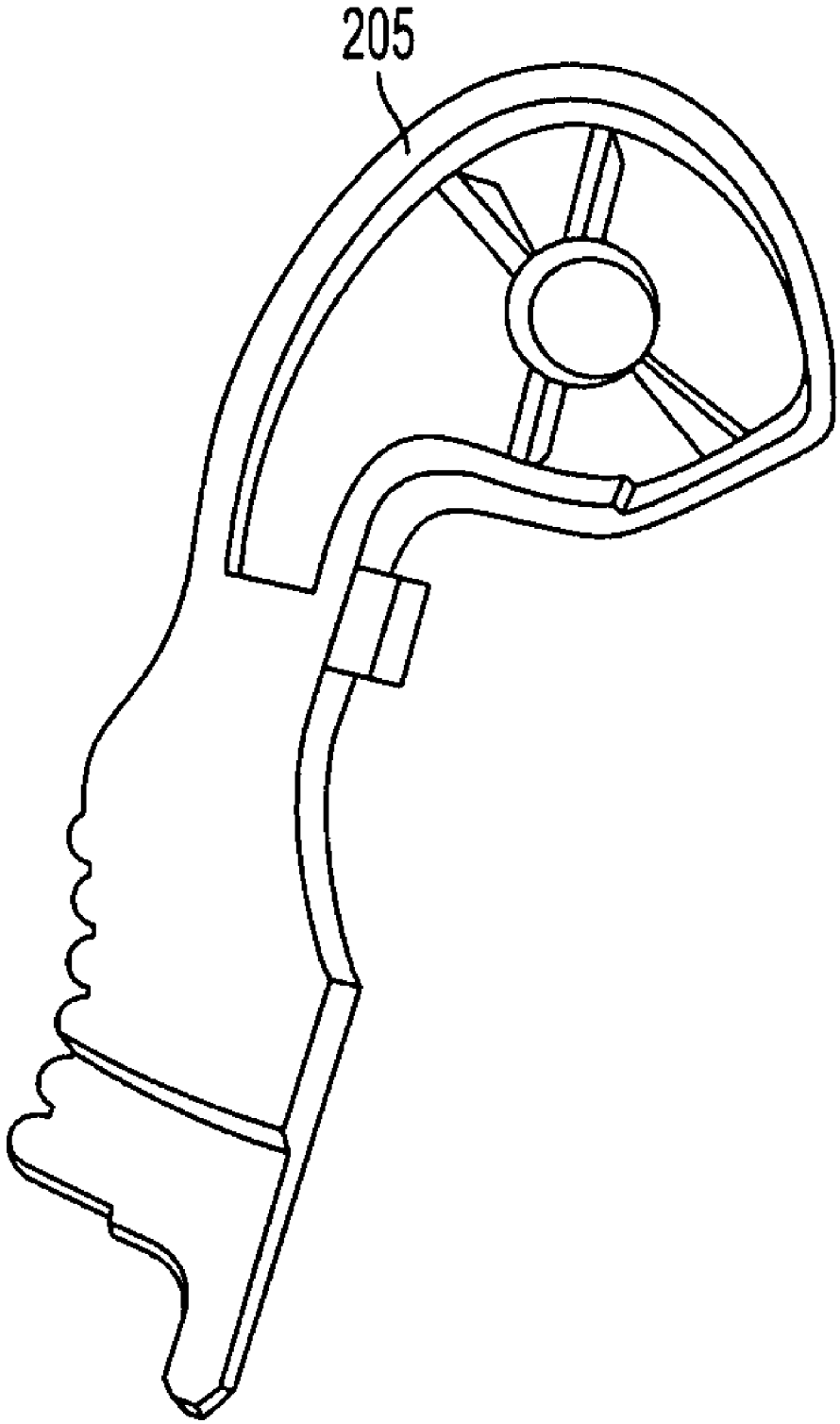
FIG. 2B illustrates an exemplary first latch according to an embodiment.
Figure 2C:
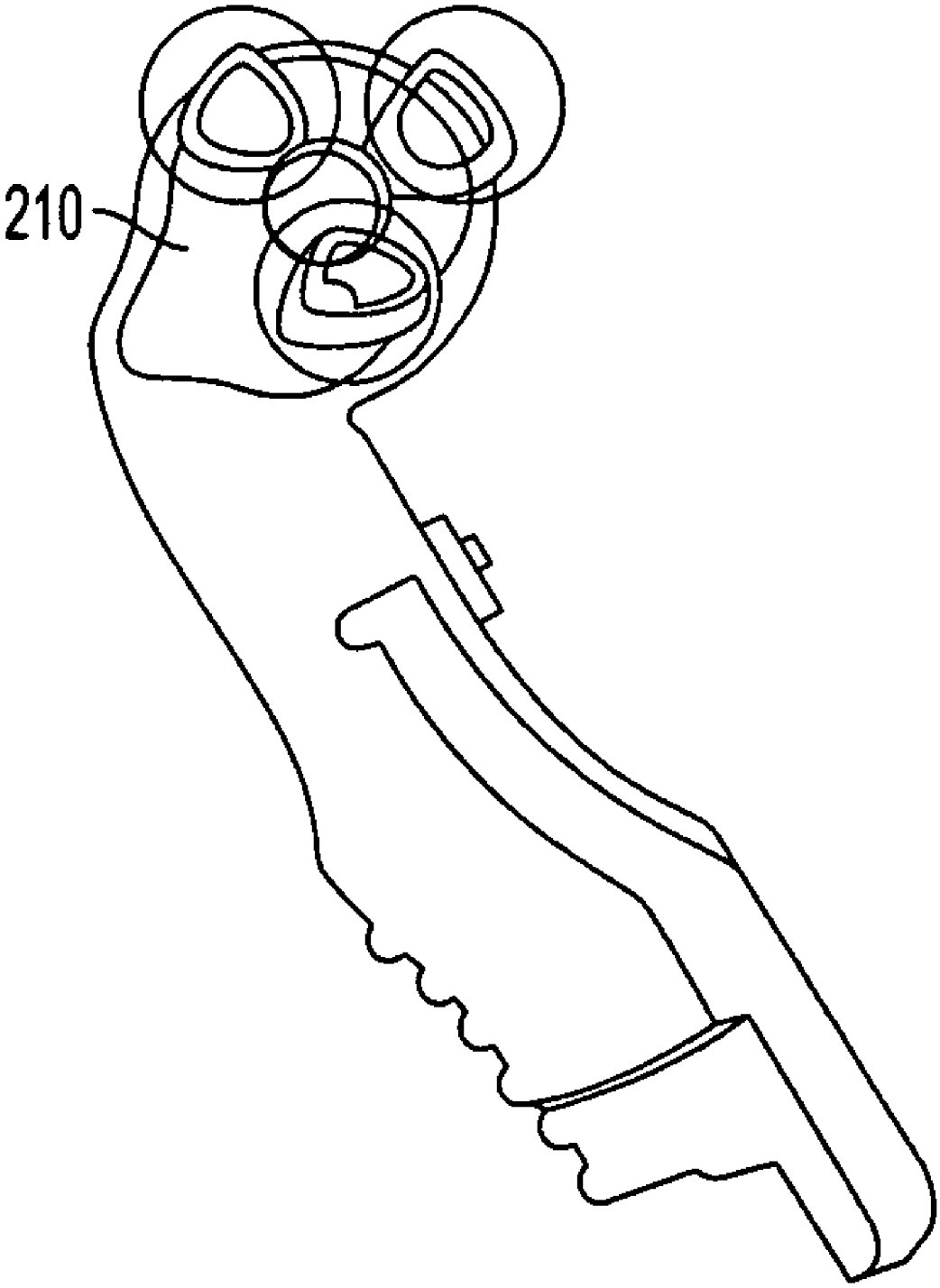
FIG. 2C illustrates an exemplary second latch according to an embodiment.

In an embodiment, a double latch 105 may include a first latch 110 and a second latch 115. FIG. 2A illustrates an exemplary double latch 200. FIG. 2B illustrates an exemplary first latch 205. FIG. 2C illustrates an exemplary second latch 210.

As illustrated by FIG. 2A, the first latch 205 and/or the second latch 210 may include a plurality of teeth 215, 220. The teeth may be located on an outer bottom portion of the first latch 205 and/or the second latch 210 according to an embodiment.

In an embodiment, the first latch 205 may be connected to the second latch 210 by a snap-fit connection, a press-fit connection, a screw, a bolt and/or any other suitable fastening device. In an embodiment, the first latch 205 and the second latch 210 may pivot about the connection and/or fixing. In an embodiment, the first latch 205 may be integrally formed with the second latch 210.

Figure 3A:
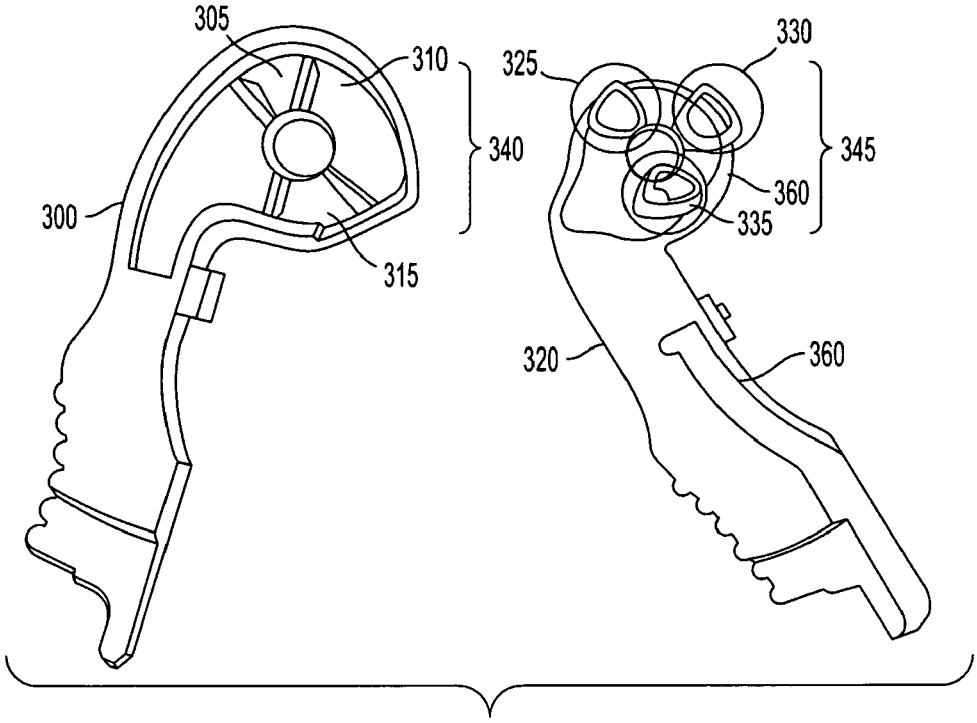
FIG. 3A illustrates exemplary interlocking features of a first latch and second latch according to an embodiment.
Figure 3B:
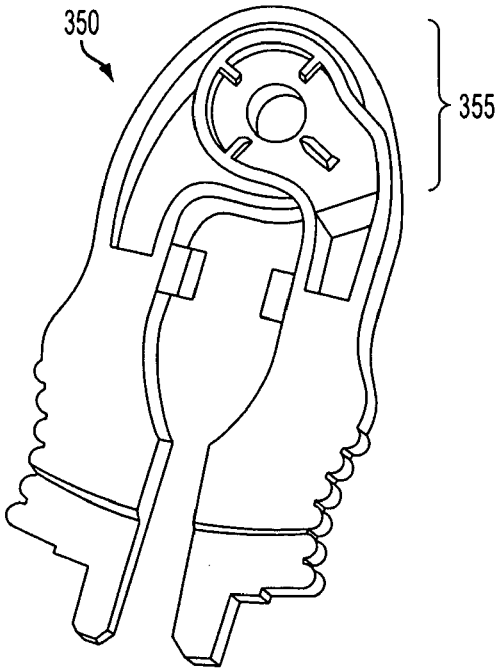
FIG. 3B illustrates an exemplary locking mechanism according to an embodiment.

FIG. 3 illustrates exemplary interlocking features of a first latch 300 and second latch 320. As illustrated by FIG. 3A, a first latch 300 may include one or more notches 305, 310, 315. In an embodiment, each notch may align with and interconnect with a protrusion 325, 330, 335 on a second latch 320. Although FIG. 3A depicts three protrusions and three notches, more, fewer, alternate and/or additional protrusions and/or notches may be used within the scope of this disclosure.

As illustrated by FIG. 3A, the notches 305, 310, 315 may be located on a top portion 340 of the first latch 300 and the protrusions 325, 330, 335 may be located on a top portion 345 of the underside 360 of the second latch 320. In an embodiment, the notches 305, 310, 315 may be evenly spaced about the top portion 340 of the first latch 300. Similarly, the protrusions 325, 330, 335 may be evenly spaced about the top portion of the underside 360 of the second latch 320. For example, as illustrated by FIG. 3A, the notches 305, 310, 315 may be arranged in a substantially triangular configuration. Similarly, the protrusions 325, 330, 335 may be arranged in a substantially triangular configuration.

In an embodiment, this interlocking feature may restrict angular movement between the first latch 300 and the second latch 320. It may also minimize a location engagement depth between each latch 300, 320 and a fastening device around which each latch may pivot. In an embodiment, the location engagement depth may be the depth of the fastening device. For example, referring to FIG. 3B, when interlocked, the first latch 300 and the second latch 320 may form a double latch 350. In an embodiment, the interlocking feature may allow the depth of a top portion 355 of the double latch to be approximately the same depth as the top portion 340 of the first latch 300.

Figure 8:
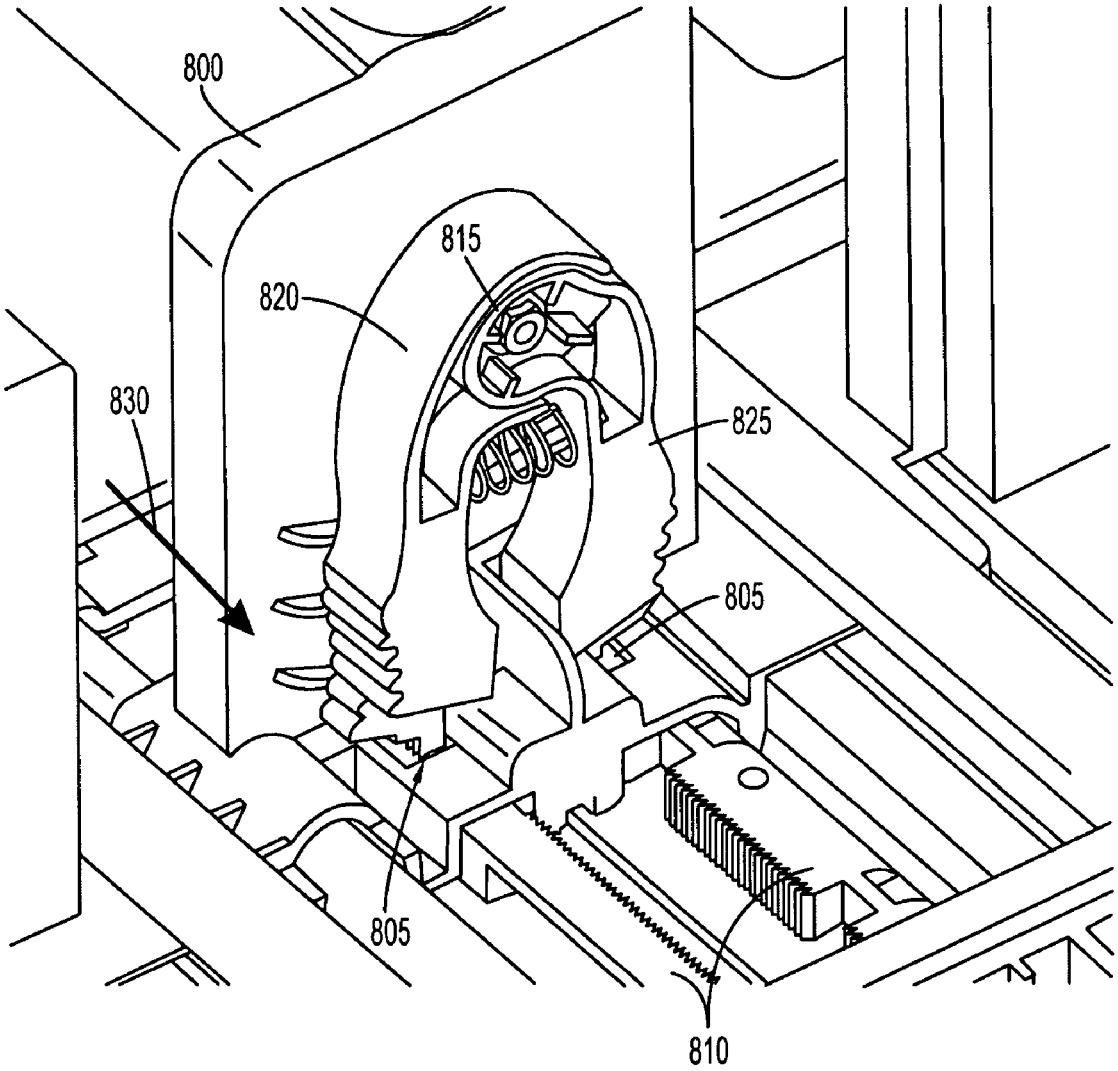
FIG. 8 illustrates a portion of an exemplary guide assembly according to an embodiment.

FIG. 8 illustrates a portion of an exemplary guide assembly according to an embodiment. As illustrated by FIG. 8, a guide assembly 800 may include one or more restraints 805. A restraint 805 may be moveably coupled to a tray. For example, as illustrated by FIG. 8, a restraint 805 may be configured to surround and move along at least a portion of a track 810. In an embodiment, a restraint 805 may be fabricated from plastic, metal and/or other similar materials. A restraint 805 may be integrally formed with the guide assembly 800. Alternatively, a restraint 805 may be removeably coupled to the guide assembly 800.

In an embodiment, a restraint 805 may be positioned in front of at least a portion of the locking mechanism 815. For example, as illustrated by FIG. 8, a restraint may be positioned in front of the first latch 820 and/or the second latch 825 of a double latch. In an embodiment, a restraint 805 may be positioned so that it is in contact with at least a portion of the locking mechanism 815. For example, as illustrated by FIG. 8, a restraint 805 may be in contact with at least a portion of a latch 820, 825, such as the outer bottom portion of the latch that includes a plurality of teeth.

In an embodiment, a restraint 805 may help limit the rotation or movement of a locking mechanism 815 relative to a guide assembly 800 and/or a tray when a force is applied to the tray, the guide assembly and/or the like. For example, a restraint 805 may prevent a latch 820, 825 from rotating or otherwise changing position relative to the guide assembly 800 and/or the tray when the tray is slammed shut. For example, a restraint may restrain a latch in the direction shown by the arrow 830 in FIG. 8. It is understood that a locking mechanism or any portion thereof may be restrained in additional and/or alternate directions within the scope of this disclosure.

In an embodiment, a tray may include one or more tracks. A track may include one or more indents and/or one or more ratchets. In an embodiment, a track may include linearly spaced indents and/or ratchets. In an embodiment, one or more teeth of the first latch and/or the second latch may engage an indent and/or a ratchet. A ratchet may include a linear series of teeth or other similar projections. In an embodiment, a projection of a ratchet may be spaced a distance away from an adjacent projection. For example, a projection may be located 1 millimeter away from an adjacent projection. In an embodiment, a ratchet may be molded into a tray. A ratchet may be fabricated from plastic, metal and/or any other suitable material.

In an embodiment, one or more indents may be located at certain positions in the tray. In an embodiment, one or more indents may include one or more beveled edges. A beveled edge may assist a latch with engagement with an indent.

In an embodiment, the location of one or more indents may correspond to standard media width sizes. In an embodiment, a standard media width size may be a width associated with media that is commonly used and/or available. For example, ISO 216 specifies exemplary standard media width sizes, such as A3, A4, A5 and the like.

Figure 4A:
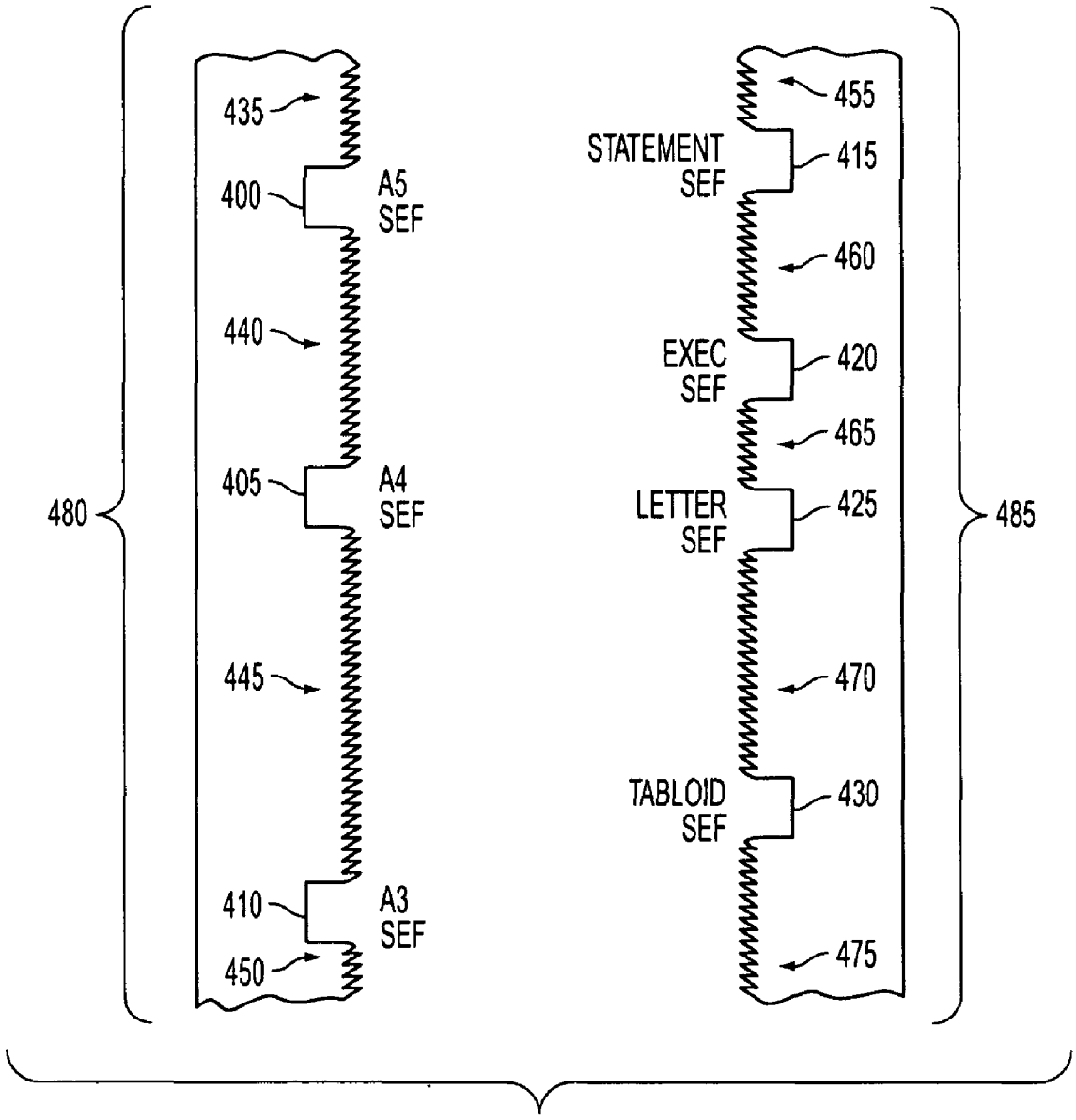
FIG. 4A illustrates exemplary placement of indents in a tray according to an embodiment.

FIG. 4A illustrates a tray having two exemplary tracks 480, 485 according to an embodiment. As illustrated by FIG. 4A, the location of the indents correspond to standard media width sizes. For example, a placement of a first indent 400 may correspond to a width size associated with A5 SEF paper. Similarly, a placement of a second indent 425 may correspond to a width size associated with Letter SEF paper.

In an embodiment, the location of a first set of indents may correspond to European standard media width sizes, while the location of a second set of indents may correspond to American standard media width sizes. For example, referring to FIG. 4A, one or more indents associated with European standard width sizes, such as A5 SEF 400, A4 SEF 405 and A3 SEF 410 may be located on a first track 480 on a first side of the tray, while one or more indents associated with American standard width sizes, such as Statement SEF 415, Executive SEF 420, Letter SEF 425 and Tabloid SEF 430, may be located on a second track 485 on a second side of the tray.

In an embodiment, one or more ratchets and/or one or more indents may be located along a track 480, 485. For example, as illustrated by FIG. 4A, a track 480 may include three indents 400, 405, 410 and four sets of ratchets 435, 440, 445, 450. As another example, a track 485 may include four indents 415, 420, 425, 430 and five ratchets 455, 460, 465, 470, 475. It is understood that more, fewer and/or alternate indents and/or ratchets may be used within the scope of this disclosure.

In an embodiment, the first latch and/or the second latch of a guide assembly may be configured to engage the first track and/or the second track at one or more intervals. In an embodiment, the intervals may be defined by a distance between adjacent projections of one or more ratchets, a distance between one or more indents and/or the like.

Figure 4B:
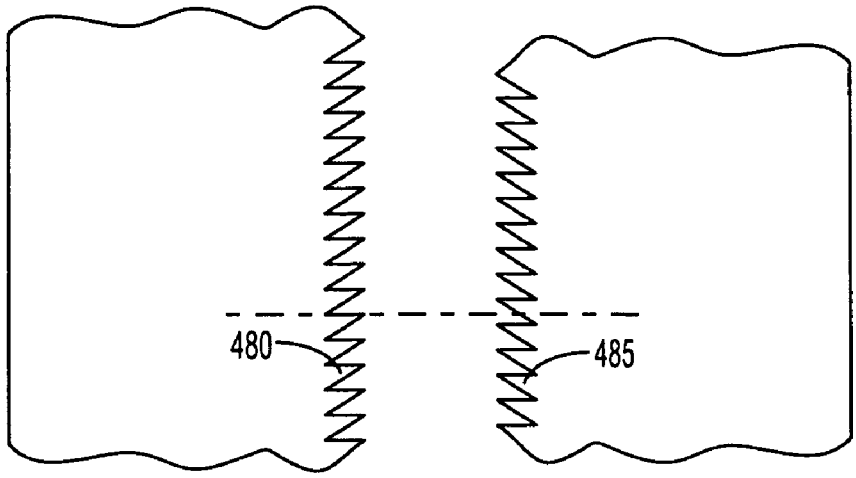
FIG. 4B illustrates two exemplary tracks according to an embodiment.

In an embodiment, a first track 480 may be offset from a second track 485 by a certain distance. For example, as illustrated by FIG. 4B, a first track 480 may be offset from a second track 485 by approximately 0.5 mm. Additional and/or alternate offset distances may be used within the scope of this disclosure.

Figure 4C:
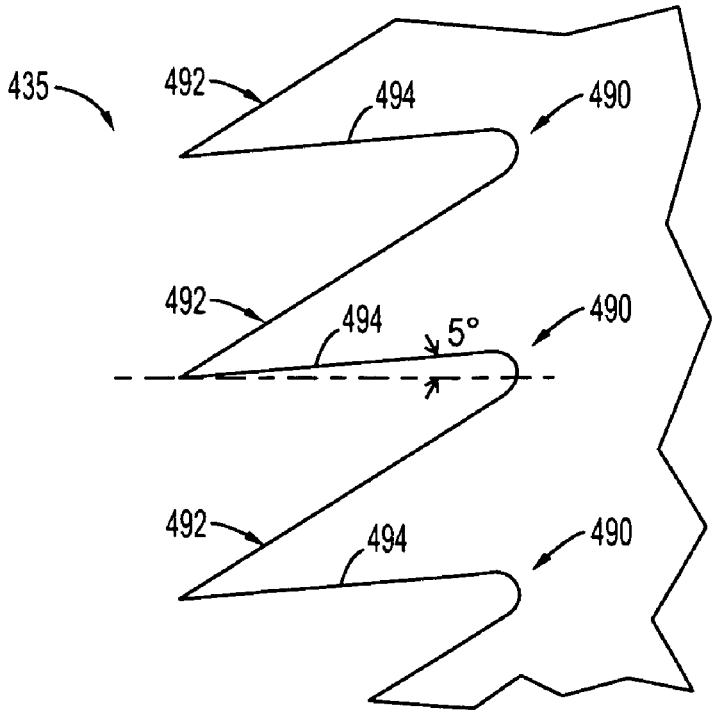
FIG. 4C illustrates a portion of an exemplary ratchet according to an embodiment.

FIG. 4C illustrates a portion of an exemplary ratchet 435 according to an embodiment. As illustrated by FIG. 4C, a ratchet 435 may include a plurality of projections 490. In an embodiment, one or more of the projections 490 may have a sloped face 492 and a hardstop face 494. In an embodiment, one or more of the hardstop faces 494 may be offset from horizontal by a certain angle. For example, as illustrated in FIG. 4C, a hardstop face 494 may be offset from the horizontal by approximately five degrees.

In an embodiment, the offset angle may assist in forcing the latches of the locking mechanism apart from each other when the tray experiences a force. In an embodiment, each latch may be pulled toward its corresponding track when a force is applied to the tray. As such, the guide assembly may remain engaged with the tracks even if the tray is moved, or if a force is applied to the tray and/or the guide assembly, such as a force associated with slamming the tray.

Figure 5A:
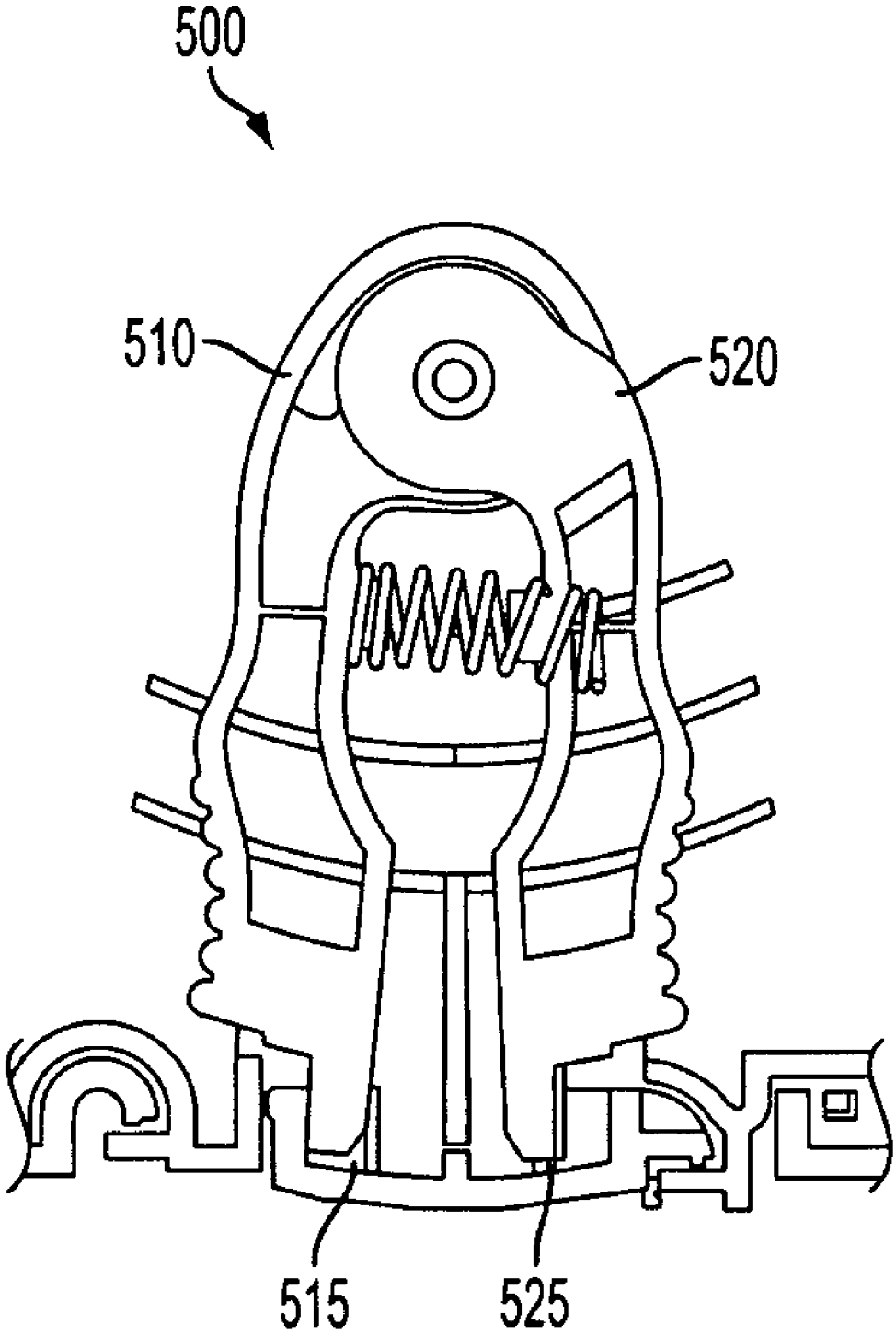
FIG. 5A illustrates an exemplary guide assembly positioned to feed A4 SEF sheets according to an embodiment.
Figure 5B:
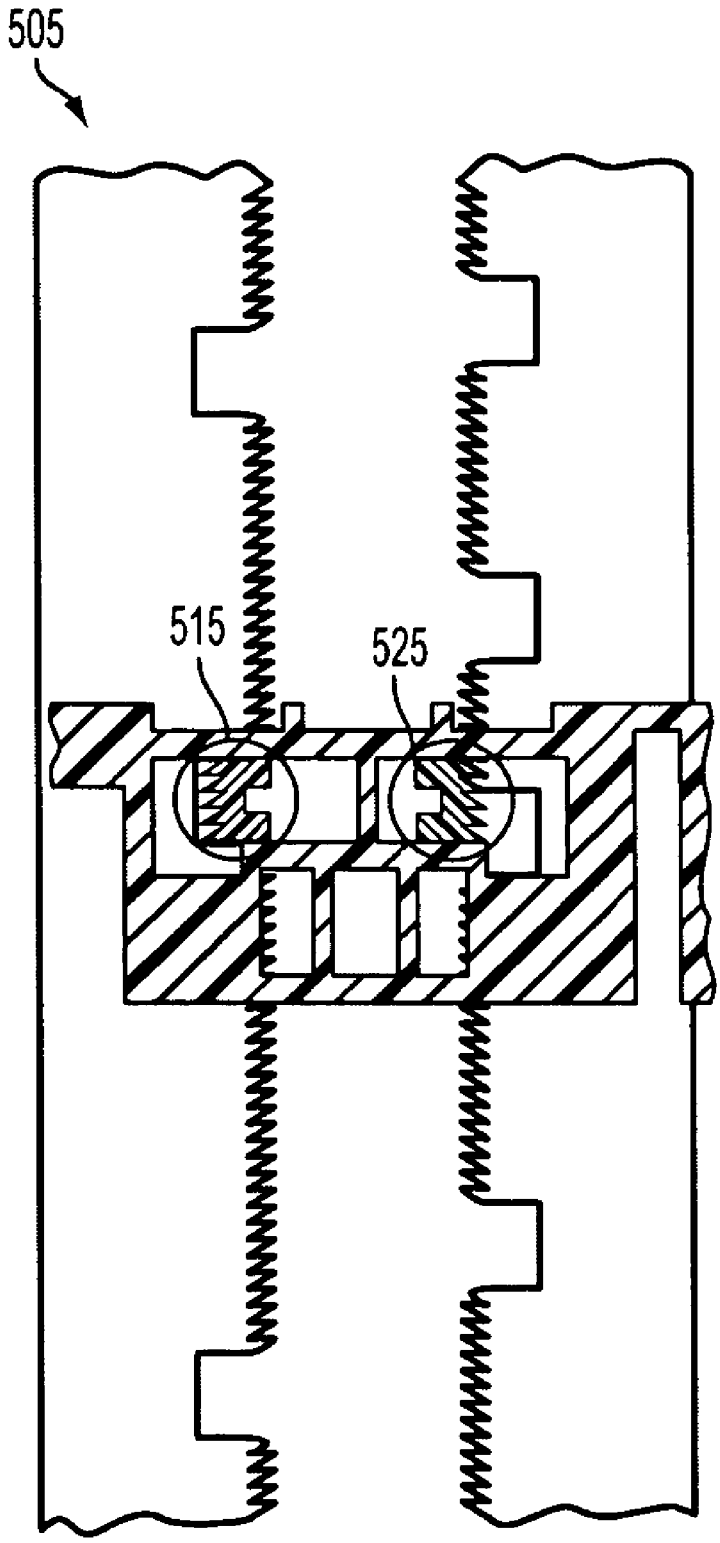
FIG. 5B illustrates an exemplary view of a tray when a guide assembly is engaged according to an embodiment.

In an embodiment, a first latch of a guide assembly may engage with an indent while a second latch of the guide assembly may engage with a ratchet. FIG. 5A illustrates an exemplary guide assembly 500 positioned to feed A4 SEF sheets according to an embodiment. FIG. 5B illustrates an exemplary view of a tray 505 when the guide assembly 500 from FIG. 5A is engaged.

As illustrated by FIG. 5A, the first latch 510 is engaged with an indent 515 associated with A4 SEF sheets. As illustrated by FIG. 5B, because there is no indent located opposite the indent 515 associated with A4 SEF, the second latch 520 may engage with a ratchet 525.

Figure 6A:
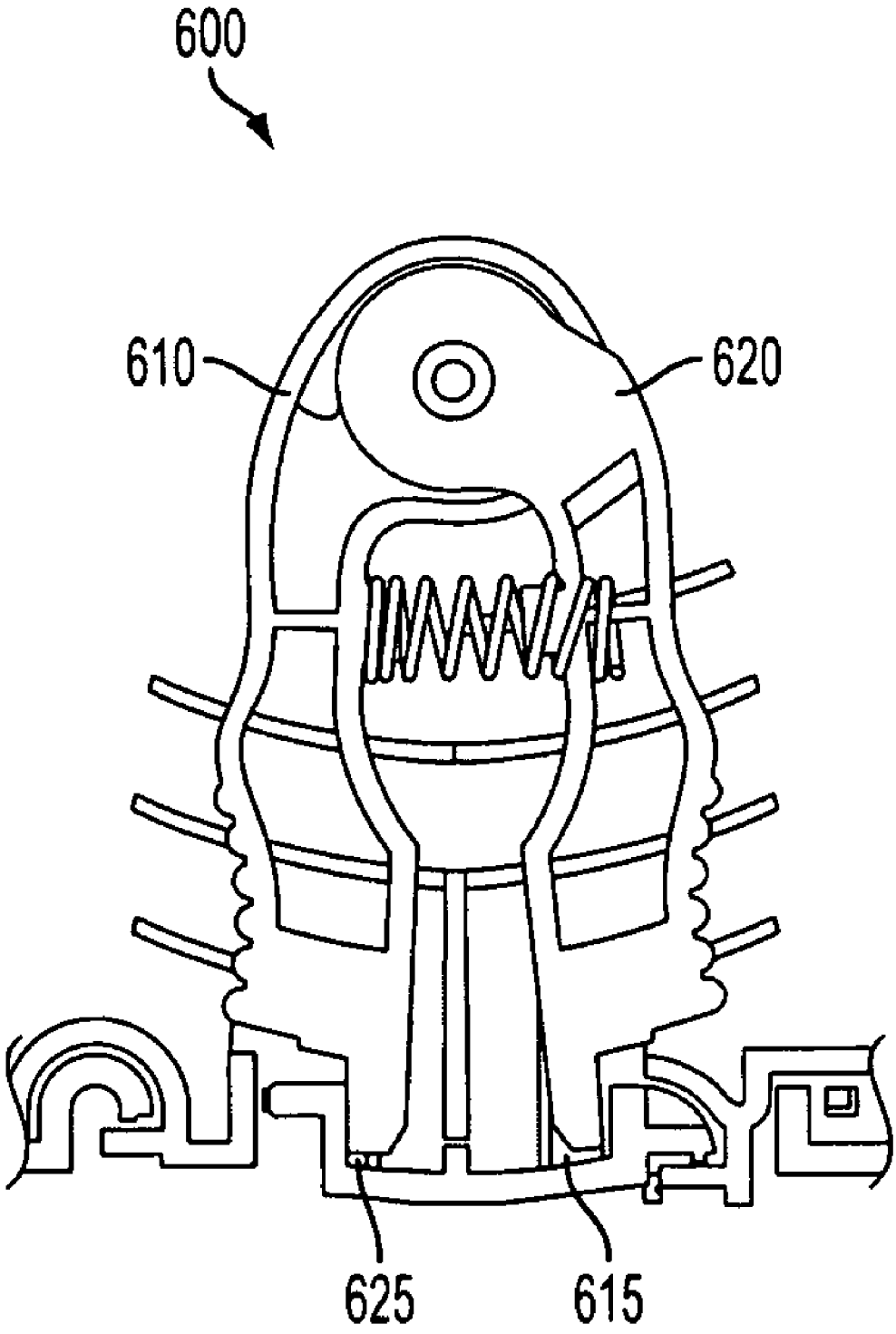
FIG. 6A illustrates an exemplary guide assembly positioned to feed Executive SEF sheets according to an embodiment.
Figure 6B:
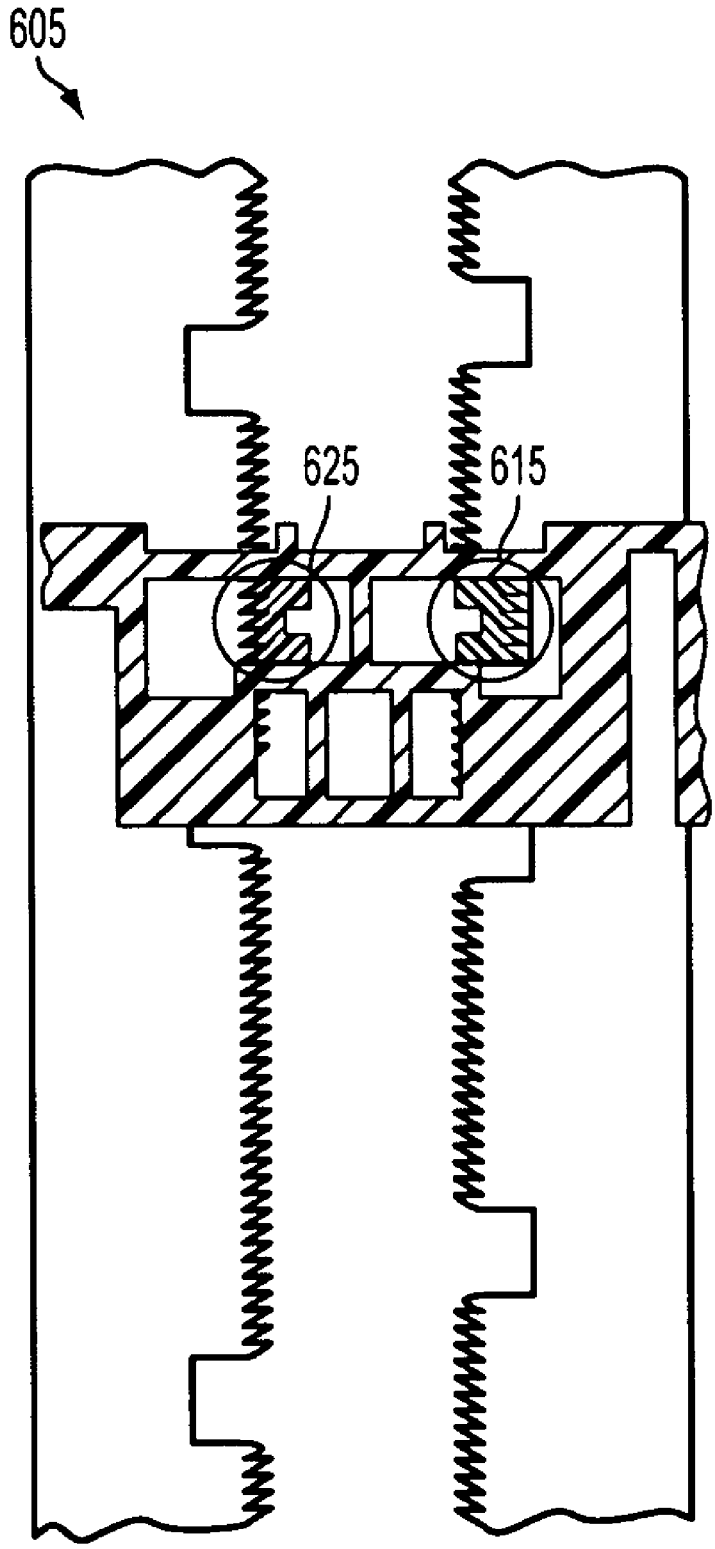
FIG. 6B illustrates an exemplary view of a tray when a guide assembly is engaged according to an embodiment.

In an embodiment, a first latch of a guide assembly may engage with a ratchet, while a second latch of the guide assembly may engage with an indent. FIG. 6A illustrates an exemplary guide assembly 600 positioned to feed Executive SEF sheets according to an embodiment. FIG. 6B illustrates an exemplary view of a tray 605 when the guide assembly 600 from FIG. 6A is engaged.

As illustrated by FIG. 6A, the second latch 620 is engaged with an indent 615 associated with Executive SEF sheets. As illustrated by FIG. 6B, because there is not indent located opposite the indent 615 associated with Executive SEF, the first latch 610 may engage with a ratchet 625.

In an embodiment, both the first latch of a guide assembly and a second latch of the guide assembly may engage with a ratchet. This may allow the guide assembly to support custom-sized media widths rather than only standard American and/or European media widths. For example, a user may position the guide assembly at a certain increment across a range of the ratchet. By using the ratchets, a user may set the guide assembly inside or outside of standard media sizes. For example, a projection of a ratchet may be spaced approximately 1 millimeter away from an adjacent projection. The range associated with the tray may be the difference between the largest width the tray supports and the smallest width the tray supports. For example, the largest width media a tray may support may be 8½×11 LEF having a width of 279.4 mm. The smallest width media the tray may support may be 8½×5½SEF having a width of 139.7 mm. The range associated with this tray may be 139.7 mm (i.e., 279.4 mm-139.7 mm). If the ratchet projections are located at approximately every 1 millimeter, a user may be able to position the guide at any 1 mm increment across this range.

Figure 7A:
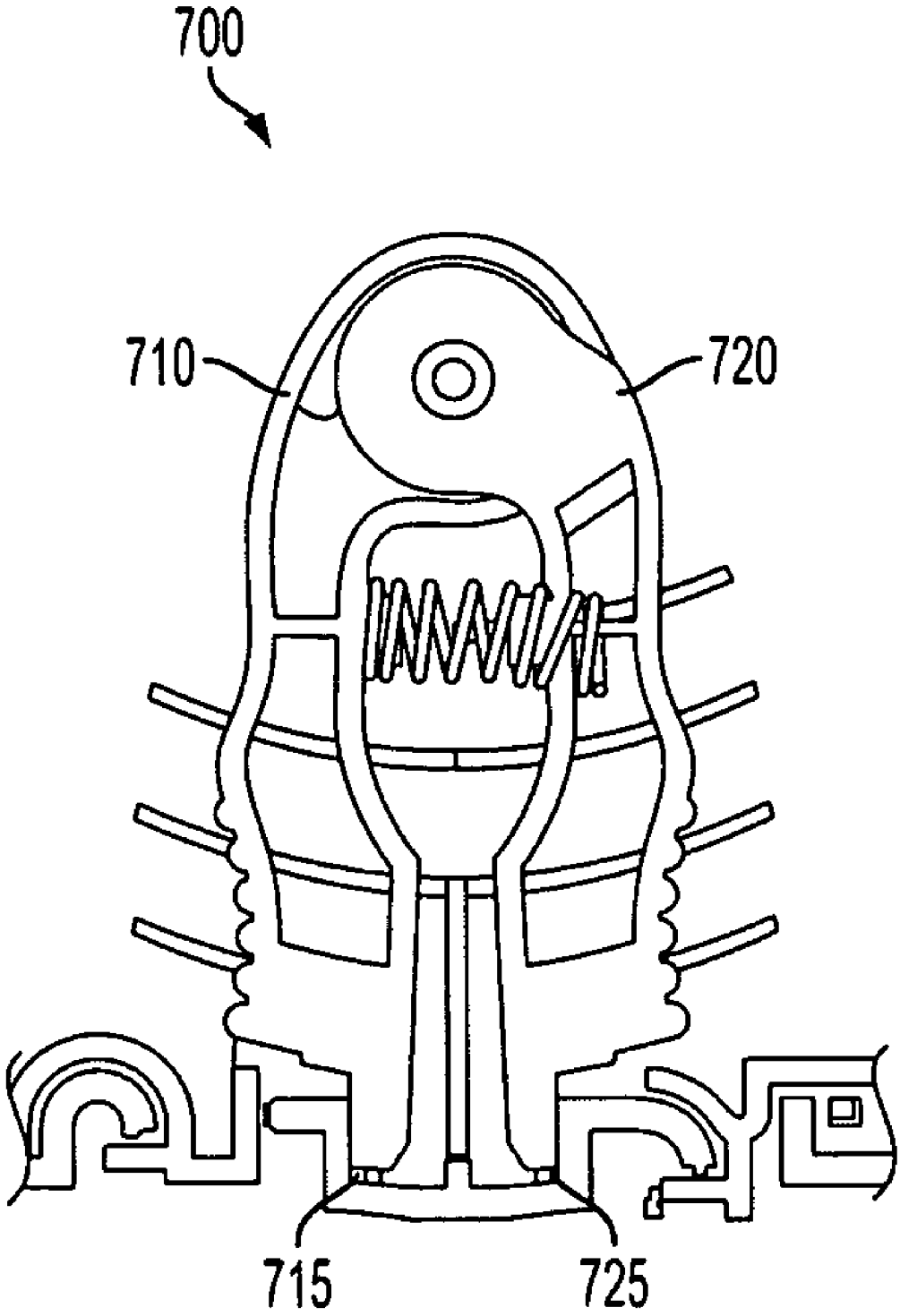
FIG. 7A illustrates an exemplary guide assembly positioned to feed custom-sized sheets according to an embodiment.
Figure 7B:
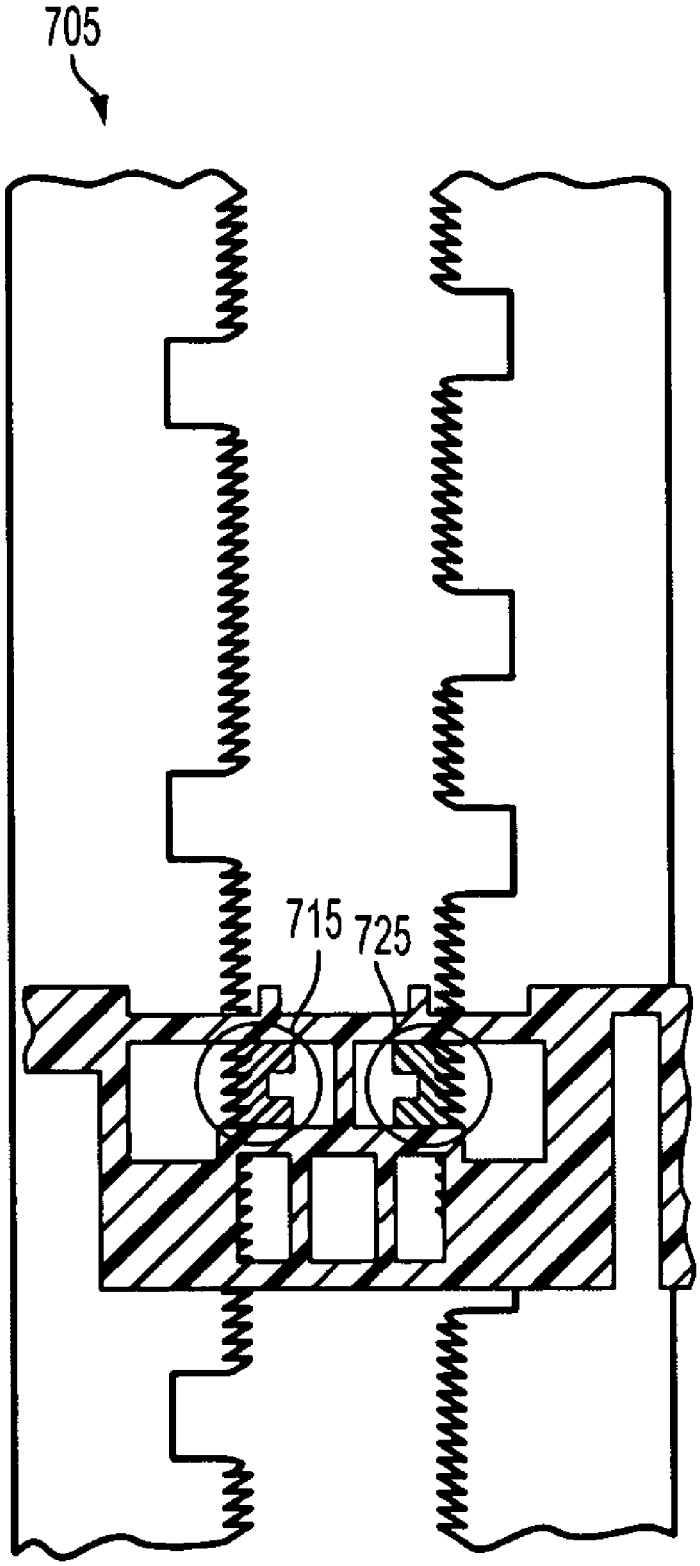
FIG. 7B illustrates an exemplary view of a tray when a guide assembly is engaged according to an embodiment.

FIG. 7A illustrates an exemplary guide assembly 700 positioned to feed custom-sized sheets according to an embodiment. FIG. 7B illustrates an exemplary view of a tray 705 when the guide assembly 700 from FIG. 7A is engaged. As illustrated by FIG. 7A, the first latch 710 is engaged with a first ratchet 715, while the second latch 720 is engaged with a second ratchet 725 located opposite the first ratchet 715.

In an embodiment, a guide assembly may include a compression element, such as a spring and/or the like. Referring back to FIG. 1, the compression element 120 may extend from a first latch 110 to a second latch 115. In an embodiment, the compression element 120 may facilitate locking and/or unlocking of the guide assembly 100. For example, to unlock the guide assembly 100, the first latch 110 and the second latch 115 may be squeezed together. Pressure applied to the first latch 110 and the second latch 115 may compress the compression element 120 which may release the first latch 110 and the second latch 115 from engagement with an indent and/or a ratchet.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A tray assembly for a print device, the tray assembly comprising:

a print device tray having at least a first track and a second track, wherein the first track comprises one or more indents and one or more first ratchets, wherein the second track comprises one or more second ratchets, wherein each of the first ratchets and each of the second ratchets comprise a plurality of projections;

a guide assembly comprising:

a first latch comprising a plurality of first teeth configured to engage the first track and a plurality of notches located on a top portion of the first latch, wherein the plurality of first teeth are located on an outer lower portion of the first latch, a second latch comprising a plurality of second teeth configured to engage the second track and a plurality of protrusions located on a top portion of an underside of the second latch, wherein the plurality of second teeth are located on an outer lower portion of the second latch, wherein each notch is configured to interconnect with a respective protrusion of the plurality of protrusions; and a compression element configured to lock and unlock the guide assembly.

2. The tray assembly of claim 1, wherein each projection is located a distance from each adjacent projection.

3. The tray assembly of claim 2, wherein the distance from a projection to each adjacent projection is approximately 1 millimeter.

4. The tray assembly of claim 1, wherein an indent comprises a beveled edge.

5. The tray assembly of claim 1, wherein an indent is located in accordance with a standard media width.

6. The tray assembly of claim 1, wherein: the first latch is coupled to the second latch by a fastening device, wherein the first latch and the second latch are configured to pivot about the fastening device.

7. The tray assembly of claim 1, wherein a first end of the compression element is coupled to the first latch, wherein a second end of the compression element is coupled to the second latch.

8. The tray assembly of claim 1, wherein:

the second latch is configured to engage the second track at one or more intervals, wherein each interval is defined by a distance between adjacent projections of each second ratchet, the first track at one or more intervals, wherein each interval is defined by one or more of the following:

a distance between adjacent projections of each first ratchet, and a distance between each indent.

9. The tray assembly of claim 1, wherein:

the print device tray comprises one or more first connecting elements, the guide assembly comprises one or more second connecting elements, wherein the second connecting elements are complementary to the first connecting elements, and the guide assembly is configured to connect to the tray via the one or more first connecting elements and the one or more second connecting elements.

10. The tray assembly of claim 9, wherein one or more of the first connecting elements are integrally formed with the print device tray, wherein one or more of the second connecting elements are integrally formed with the guide assembly.

11. The tray assembly of claim 1, wherein the first track is offset from the second track by a distance.

12. The tray assembly of claim 1, wherein at least one of the plurality of projections comprises a first face and a second face, wherein the second face is offset from horizontal by an angle.

* * * * *